US008240886B2

(12) United States Patent
Lai

(10) Patent No.: US 8,240,886 B2
(45) Date of Patent: Aug. 14, 2012

(54) ILLUMINATION DEVICE WITH ANTI-GLARE FUNCTION

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 343 days.

(21) Appl. No.: 12/649,545

(22) Filed: Dec. 30, 2009

(65) Prior Publication Data

US 2010/0214787 A1 Aug. 26, 2010

(30) Foreign Application Priority Data

Feb. 26, 2009 (CN) ..... 2009 1 0300583

(51) Int. Cl.
*F21V 13/04* (2006.01)
*F21V 5/04* (2006.01)

(52) U.S. Cl. ..... 362/309; 362/308; 362/336

(58) Field of Classification Search ..... 362/307–309, 362/335, 336

See application file for complete search history.

(56) References Cited

U.S. PATENT DOCUMENTS 2,456,166 A * 12/1948 Arenberg ..... 362/308
3,283,138 A * 11/1966 Justice et al. ..... 362/309
3,283,140 A * 11/1966 Rex ..... 362/309
3,480,772 A * 11/1969 Gough ..... 362/309
4,288,847 A * 9/1981 Elmer ..... 362/297
5,313,379 A * 5/1994 Lemons et al. ..... 362/346
5,836,674 A 11/1998 Nishitani et al.
7,547,116 B2 * 6/2009 Walker et al. ..... 362/431
7,578,605 B1 * 8/2009 Mullins et al. ..... 362/297
7,828,456 B2 * 11/2010 Boyer et al. ..... 362/153.1

FOREIGN PATENT DOCUMENTS

TW 200907229 A 2/2009

* cited by examiner

*Primary Examiner* — Alan Cariaso

(74) *Attorney, Agent, or Firm* — Altis Law Group, Inc.

(57) ABSTRACT

An illumination device for illuminating a road includes a lamp holder and a light source. The lamp holder has an inner surface and a cavity defined by the inner surface. The light source is arranged in the cavity, and light emitted from the light source is redirected by the lamp holder to establish an illuminating area on the road. The illuminating area is consisted of a first angular range and a second angular range which are located at two opposite sides of the lamp holder along a lengthwise direction of the road. The first angular range is directed at an angle Φ1 from a downward vertical line through the lamp holder, and the second angular range is directed at an angle Φ2 from the downward vertical line, wherein, Φ2>Φ1, Φ1≦45°.

14 Claims, 7 Drawing Sheets

ILLUMINATION DEVICE WITH ANTI-GLARE FUNCTION

BACKGROUND

1. Technical Field

The disclose generally relates to illumination devices, and particularly, to an illumination device with anti-glare function.

2. Description of Related Art

Light emitting diodes (LEDs) are extensively used as light sources due to their high luminous efficiency, low power consumption, and long lifespan. Although the LEDs can emit bright light to illuminate a dark environment, a glare may occur when bright light from the LEDs directly flashes into the eyes. For example, as shown in FIG. 5, in a typical application of the LEDs 101, the LEDs 101 are arranged on a ceiling to provide overhead lighting. Because the LEDs 101 emit light radially, the user with an elevation angle with respect to the LEDs 101 in a range from about 45 degrees to about 85 degrees may see glares from the LEDs 101. The glare causes eye strain and fatigue, which may lead to serious headaches and other discomforts.

Referring to FIG. 6, a road lamp 201 is adapted for lighting the road to achieve an illumination range with a center of road lamp 201. A part of the illumination range along an X-direction is greater than that along a Y-direction. The X-direction is perpendicular to the Y-direction as shown, and the X-direction expresses the extending direction of the road 11. The distribution curve of light intensity of the road lamp 201 in the X-direction is shown in FIG. 7; as shown, point A corresponds to 50% of the maximal light intensity of the road lamp 201 in a range from 0° to 90° from a downward vertical line. And point B corresponds to the maximal light intensity of the road lamp 201 in the range from 0° to 90° from the downward vertical line. It can be seen that the angle θ between the light which has 50% maximal light intensity of the light of the road lamp 201 with the downward vertical line is used to characterize radiation range of the road lamp 201. However, the radiation range in the extending direction of the road distributes symmetrically respect to a center of road lamp 201. Specifically, the radiation range is consisted of a first angular range and an opposite second angular range located in the X-direction. The first angular range is directed at an angle θ1 between the light with 50% maximal light intensity of the light with the downward vertical line toward a part of illumination area. The second angular range is directed at an angle θ2 between the light with 50% maximal light intensity of the light with the downward vertical line toward the other part of illumination area. The angles θ1, θ2 are equivalent, usually θ1=θ2=75°, resulting in glare to the drivers on the road.

Therefore, there is a desire to provide an illumination device that overcomes the described limitations.

BRIEF DESCRIPTION OF THE DRAWINGS

Many aspects of the disclosures can be better understood with reference to the following drawings. The components in the drawings are not necessarily drawn to scale, the emphasis instead being placed upon clearly illustrating the principles of the disclosures. Moreover, in the drawings, like reference numerals designate corresponding parts throughout the different views.

DETAILED DESCRIPTION

Figure 1:
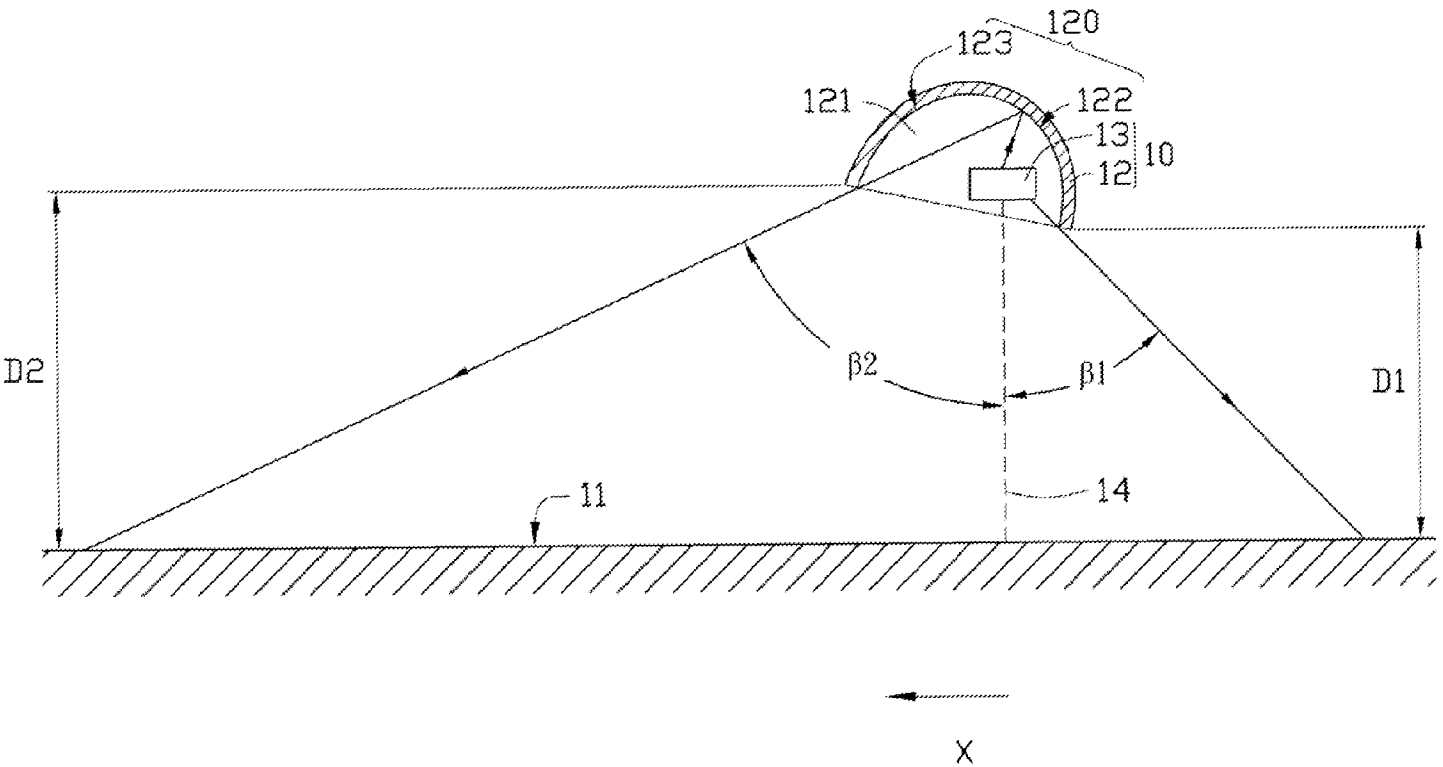
FIG. 1 is cross-sectional view of an illumination device in accordance with a first exemplary embodiment.

Referring to in FIG. 1, an illumination device 10 provided in a first exemplary embodiment, which is adapted for lighting a road 11, includes lamp holder 12 and a light source 13.

The lamp holder 12 defines a cavity 121 in an inner surface 120. The light source 13 is arranged in the cavity 121, and the inner surface 120 mostly surrounds the light source 13. In the illustrated embodiment, the inner surface 120 includes a first curved reflective part 122 and a second curved reflective part 123 connected to each other. Along an X-direction, the first, second curved reflective parts 122, 123 are located at opposite sides of a downward vertical line 14 through the light source 13. The X-direction is the extending direction of the road surface 11 as shown. The first, second curved reflective parts 122, 123 are shaped and positioned to receive the light from the light source 13, and reflex the light onto the road 11, thus illuminating the road 11.

The light source 13 may be a fluorescent lamp, a metallic halide lamp, an incandescent lamp, a high intensity discharge lamp (HIDL), a high intensity neon lamp, a light emitting diode (LED) lamp and so on.

Figure 2:
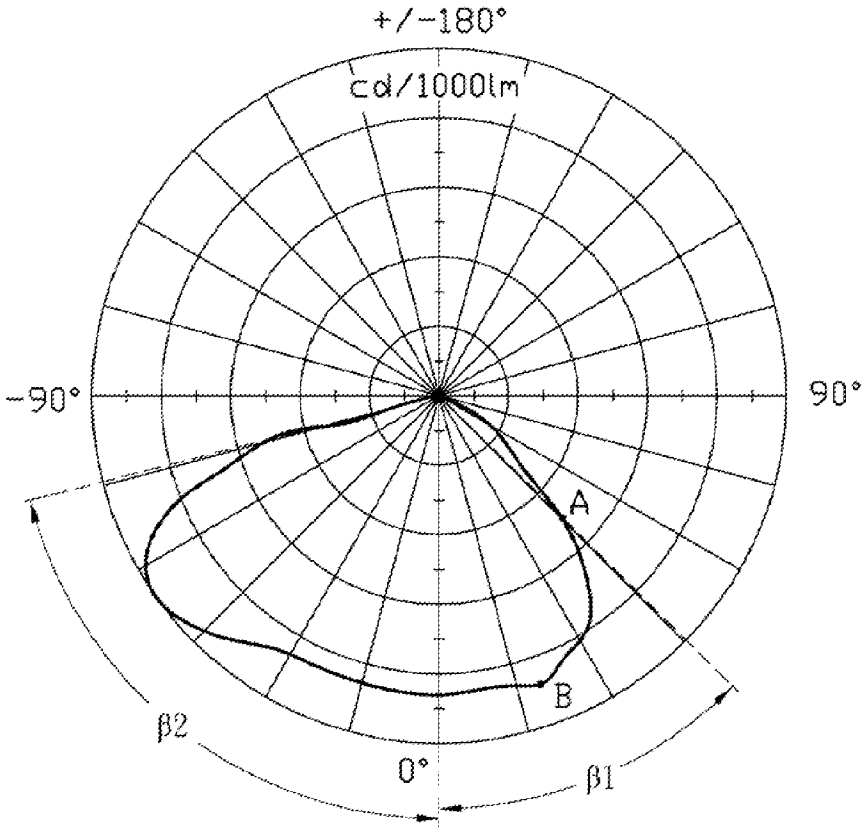
FIG. 2 is the distribution curve of the illumination device of FIG. 1.

Only a fraction of the light emitted from the light source 13 illuminates the road 11 directly. Most of the light is reflected onto the road 11 by the first, second curved reflective parts 122, 123. The second curved reflective part 123 reflects the light at a first angular range towards the road 11. The first angular range is ideally directed at an angle β1 from the downward vertical line 14. The first curved reflective part 122 directs the light introduced thereon into a second angular range toward the road 11. The second angular range is ideally directed at an angle β2 from the downward vertical line 14. The first angular range and the second angular range are located at opposite sides of the downward vertical line 14, along a lengthwise extending direction of the road 11. Referring to FIG. 2, a distribution curve on the X-direction of the illumination device 10 is shown. Point A corresponds to 50% of the maximal light intensity of the illumination device 10 in a range from 0° to 90° from the downward vertical line. Point B corresponds to the maximal light intensity of the illumination device 10 in a range from 0° to 90° from the downward vertical line. It can be seen that the angle θ1 between the downward vertical line with the light which has 50% maximal light intensity of the light irradiated toward the side of first curved reflective part 122, is less than the angle β2 between the downward vertical line with the light which has 50% maximal light intensity of the light irradiated toward the side of second curved reflective part 123. In the illustrated embodiment, the angle β1 is nearly equal to 45°, and the angle θ2 is approximately equal to 75°, which means that the second angular range redirected by the first curved reflective part 122 is wider than the first angular range redirected by the second curved reflective part 123. The minimal distance between one end of the lamp holder 12 with the first curved reflective part 122 and the road 11 is equal to D1. The minimal distance between the other end of the lamp holder 12 with the second curved reflective part 123 and the road 11 is equal to D2. In the present embodiment, D1<D2; therefore, more light from the light source 13 is be reflected by the first curved reflective part 122, resulting in β1<β2. For achieving a good anti-glare, the distance D1 can be adjusted so that the angle β1 is less than 45 degrees.

In the illustrated embodiment, due to β1<β2, and β1≦45°, the illumination device 10 is without glare at the first angular range (i.e., the angle β1) in the X-direction, simultaneously the first angular range of the illumination device 10 can be compressed appropriately, and the second angular range (i.e., the angle β2) of the illumination device 10 can be expanded. Therefore, the angular ranges of the illumination device 10 at the two opposite sides thereof are asymmetric; the light emitted from the light source 13 can be reflected to the desired area efficiently, such that the effective illuminating area on the road 11 by the light source 13 can be enlarged and simultaneously the glare can be avoided in the X-direction.

An application method for the illumination device 10 as described above, includes: the illumination device 10 is positioned on a road for lighting it; the X-direction as shown in FIG. 1 represents the car going direction. One end of the lamp holder 12 having first curved reflective part 122 is located at the car approaching side respect to the illumination device 10. Because of the angle β1≦45°, the driver will not feel dizzy when the car approaches the illumination device 10.

Figure 3:
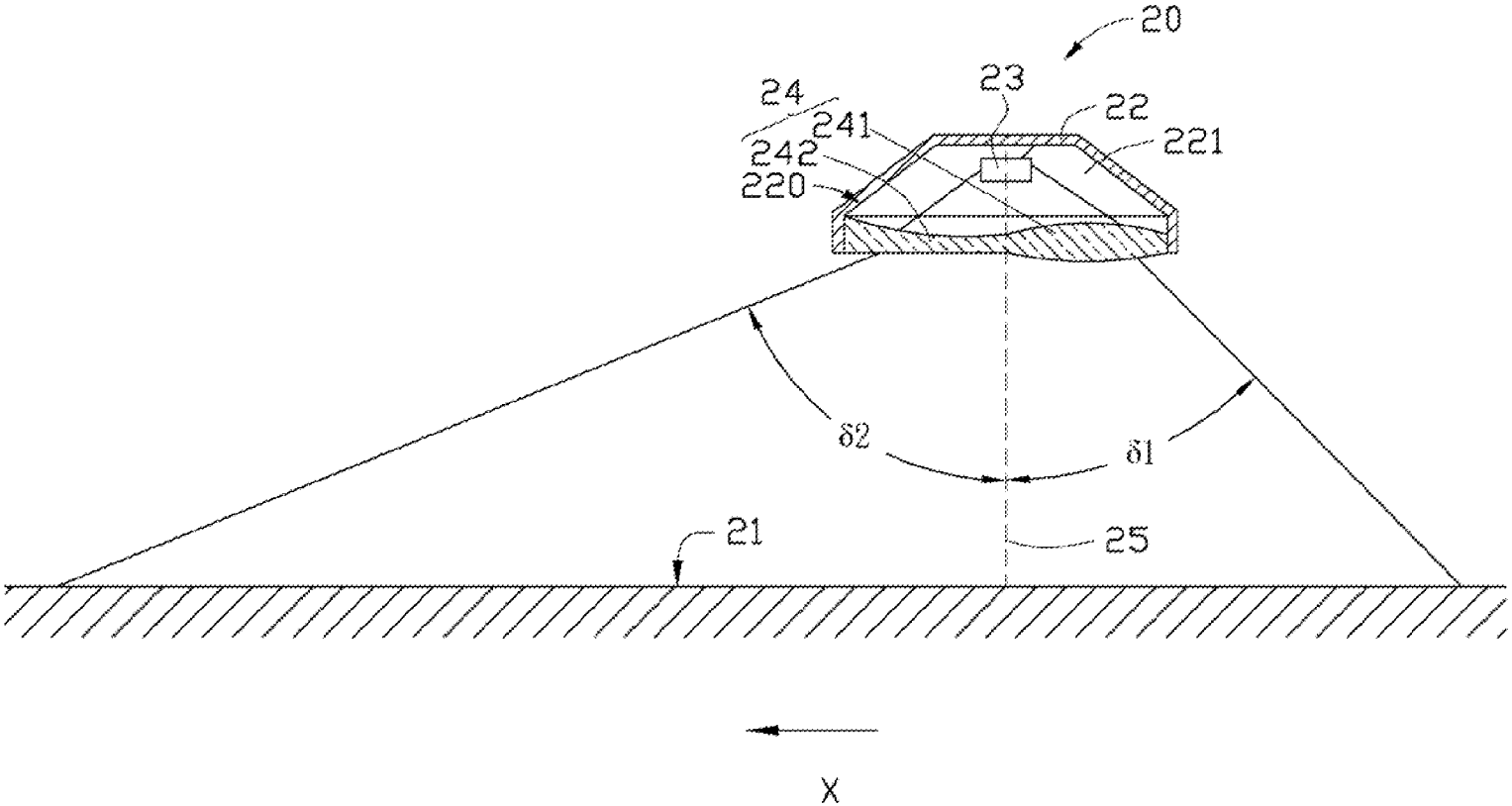
FIG. 3 is cross-sectional view of an illumination device in accordance with a second exemplary embodiment.

Referring to in FIG. 3, an illumination device 20 provided in a second exemplary embodiment, which is adapted for lighting a road 21, includes lamp holder 22 and a light source 23.

The lamp holder 22 has an inner surface 220 recessed upwardly to define a cavity 221 with an opening facing downwardly. The lamp holder 22 further includes a transparent/translucent cover 24 which is secured to the lamp holder 22 and located at the opening to cover the cavity 221. The light source 23 is arranged in the cavity 221, and the inner surface 220 mostly surrounds the light source 23. The light-pervious cover 24 includes a converging lens 241 and a diverging lens 242 adjacent to the converging lens 241. Along the X direction, the converging lens 241 and the diverging lens 242 are correspondingly located at two sides of the light source 23, in which the X-direction is the extending direction of the road 21. Light emitted from the light source 23 emits out through the converging lens 241 and the diverging lens 242. In the present embodiment, the converging lens 241 is integrally formed with the diverging lens 242. The converging lens may be a biconvex, a plano-convex, a positive meniscus and so on. Furthermore, the diverging lens may be a biconcave, a plano-concave, a negative meniscus and so on.

The light source 23 may be a fluorescent lamp, a metallic halide lamp, an incandescent lamp, a high intensity discharge lamp (HIDL), a high intensity neon lamp, a light emitting diode (LED) lamp and so on.

Light emitted from the light source 23 shines on the road 21 via the converging lens 241 and the diverging lens 242. The converging lens 241 converges the light. As a result, a first angular range ideally directed at an angle δ1 between a downward vertical line 25 through the light source 23 with the light which has 50% maximal light intensity, is compressed after the light passes through the converging lens 241. Contrastively, due to the configuration of the diverging lens 242, the diverging lens 242 enables the light passing therethrough to radially deflect from a center towards a perimeter of the diverging lens 242. Thus, a second angular range being ideally directed at an angle δ2 between the downward vertical line 25 with the light with 50% maximal light intensity is expanded after the light passes through the diverging lens 242. Therefore, the second angular range is greater than the first angular range, namely δ2>δ1. For achieving a good anti-glare effectiveness, the converging lens 241 has such a focus that the angle δ1 is equal to or less than 45 degrees. Therefore, the angular ranges of the illumination device 20 at the two opposite sides thereof are asymmetric; the light emitted from the light source 23 can be redirected to the desired area efficiently by the converging lens 241 and the diverging lens 242, such that the effective illuminating area on the road 21 by the light source 23 can be enlarged and simultaneously the glare can be avoided in the X-direction.

Figure 4:
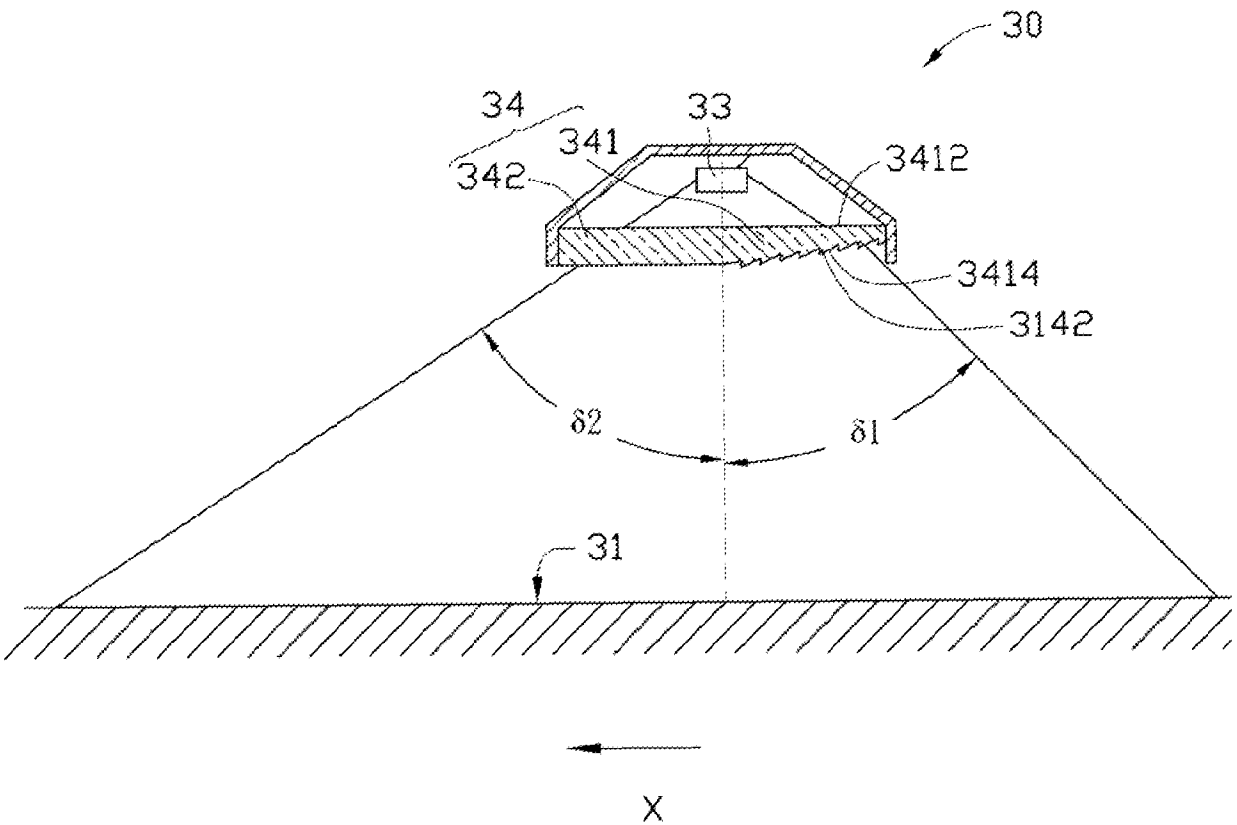
FIG. 4 is cross-sectional view of an illumination device in accordance with a third exemplary embodiment.

Referring to FIG. 4, an illumination device 30 in accordance with a third embodiment is provided. The illumination device 30 is adopted for lighting a road 31, which is similar to the second embodiment, except that the illumination device 30 includes a cover 34 consisting of a converging lens 341 and a plane lens 342. The converging lens 341 includes a light input surface 3412 facing to a light source 33 and a light output surface 3414 facing to the road 31. The light input surface 3412 and the light output surface 3414 face to opposite directions. A plurality of protrusions 3142 are formed on the light output surface 3414, which are in the form of a serration. Each protrusion 3142 forms a triangular prism. The light passing through the converging lens 341 is refracted by different regions of the protrusions 3142 and can be bent to different extents; that is, the light can be deflected from a perimeter towards a center of the converging lens 341 in the X-direction. As a result, a first angular range being ideally directed at an angle δ1 between a downward vertical line towards the road 31 through the light source 33 with the light with 50% maximal light intensity, is compressed after the light passes through the converging lens 341. Contrastively, a second angular range being ideally directed at an angle δ2 between the downward vertical line with the light with 50% maximal light intensity is almost unchanged due to the configuration of the plane lens 342, compared with the angular range of the light source 33 without the plane lens 342. Therefore, the angular ranges of the illumination device 30 at the opposite sides thereof are asymmetric; the light emitted from the light source 33 can be redirected to the desired area efficiently by the converging lens 341, such that glare can be avoided in the X-direction.

Figure 5:
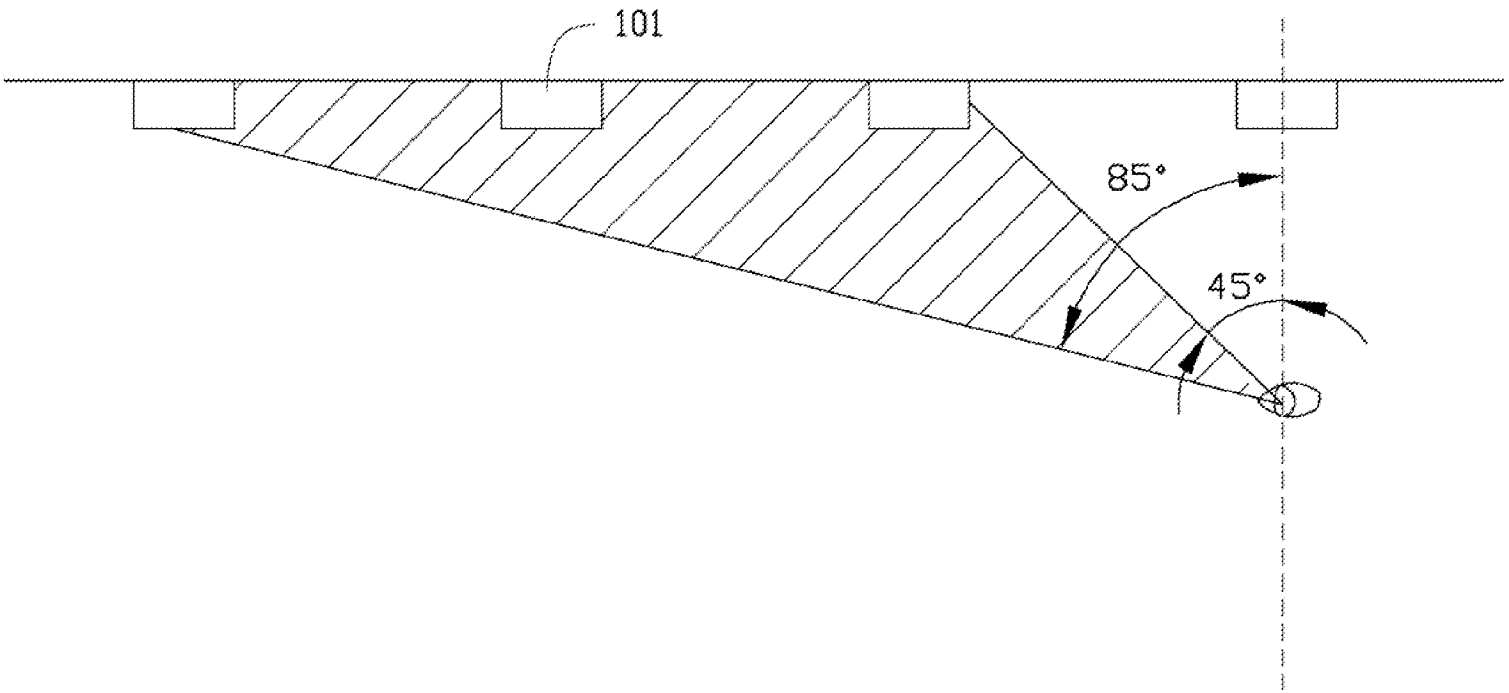
FIG. 5 (RELATED ART)
FIG. 5 is a schematic view illustrating occurrence of a typical glare.
Figure 6:
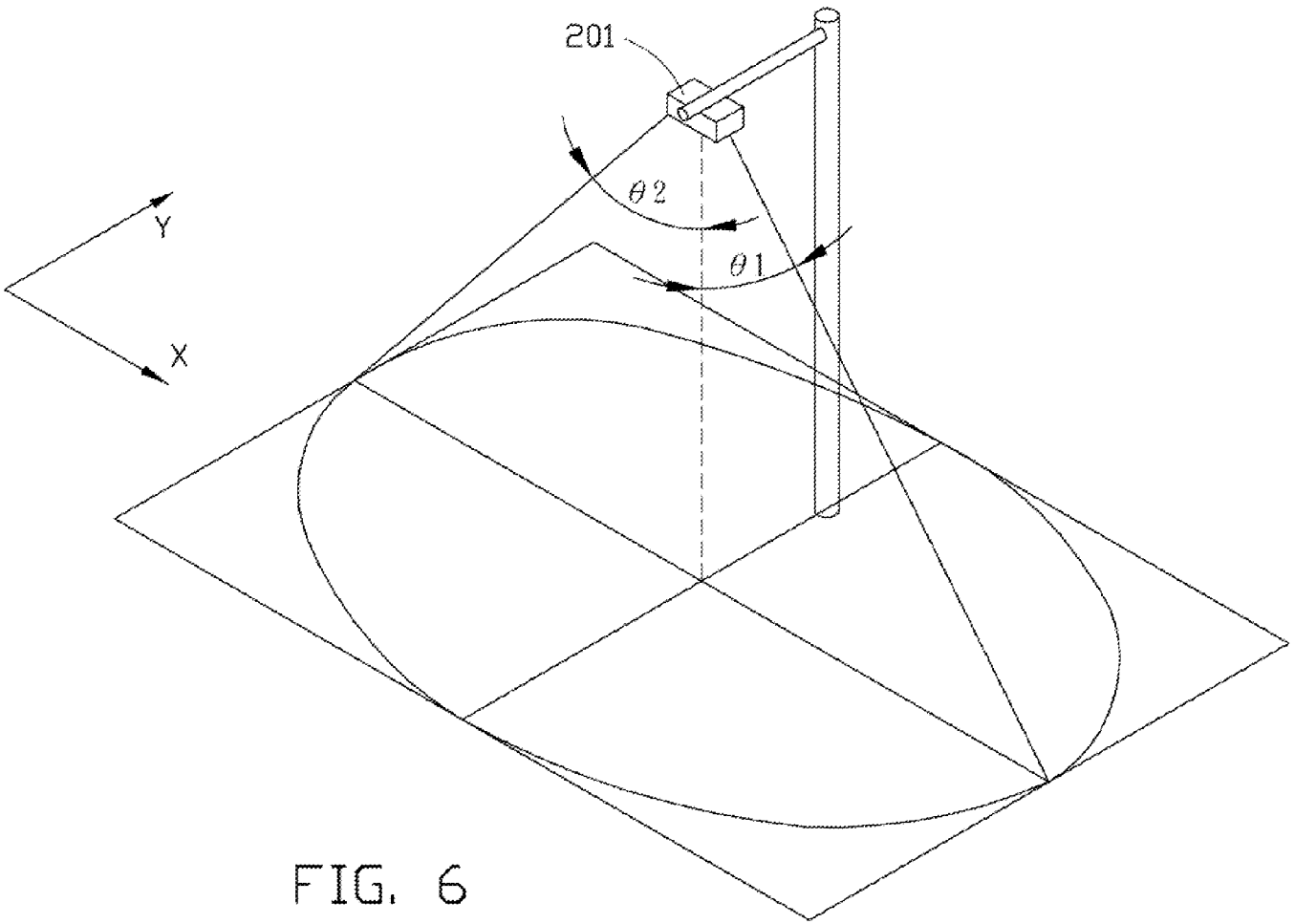
FIG. 6 (RELATED ART)
FIG. 6 is a schematic view of a typical road lamp lighting the road to achieve an illumination range.
Figure 7:
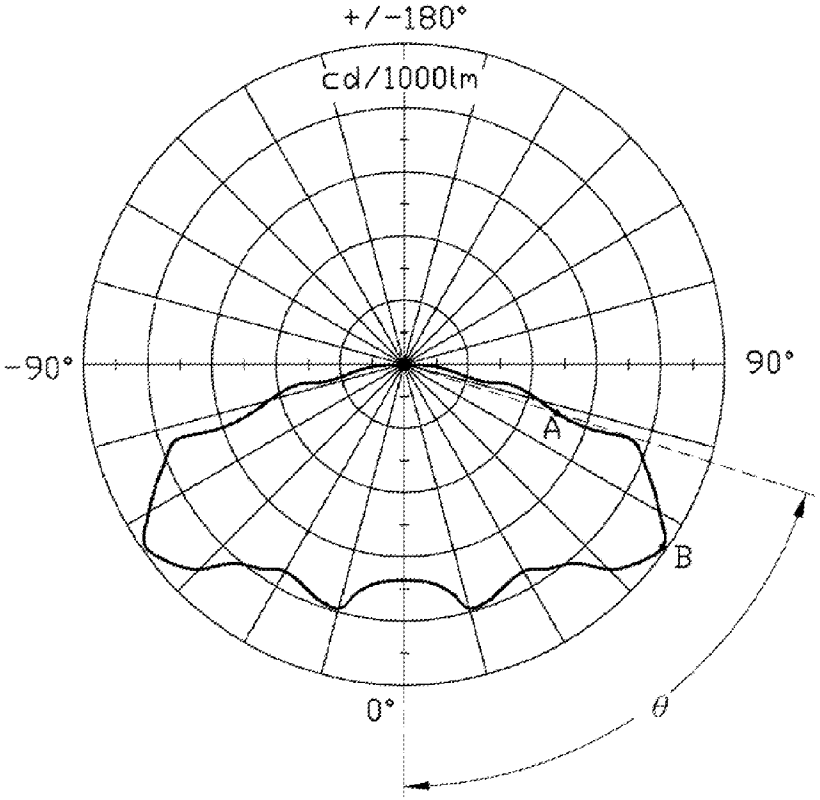
FIG. 7 (RELATED ART)
FIG. 7 is a distribution curve of light intensity of the road lamp on the X-direction of FIG. 6.

An application of the illumination device 20 or 30 as described above includes placing the illumination device 20 or 30 at a side of a road for lighting the road, wherein the X-direction as shown in FIGS. 4 and 5 represents the car movement direction. One end of the illumination device 20 having the converging lens 241 is located at the car approaching side of the illumination device 20; similarly, one end of the illumination device 30 having the converging lens 341 is located at the car approaching side of the illumination device 30. Because of the angle δ1≦45°, the driver will not feel dizzy when the car approaches the illumination device 20 or 30.

While certain embodiments have been described and exemplified above, various other embodiments will be apparent to those skilled in the art from the foregoing disclosure. The present invention is not limited to the particular embodiments described and exemplified but is capable of considerable variation and modification without departure from the scope of the appended claims.

What is claimed is:

1. An illumination device for illuminating a road, comprising:

a lamp holder having an inner surface and a cavity defined by the inner surface; and a light source arranged in the cavity and the inner surface of the lamp holder surrounding the light source, light emitted from the light source being redirected by the lamp holder to establish an illuminating area on the road below the lamp holder, the illuminating area being consisted of a first angular range and a second angular range, along a lengthwise extending direction of the road, the first angular range and the second angular range being located at opposite sides of the lamp holder, the first angular range being directed at an angle Φ1 from a downward vertical line through the lamp holder, the second angular range being directed at an angle Φ2 from the downward vertical line, wherein, Φ2>Φ1, Φ1≦45°;

wherein the lamp holder further comprises a light-pervious cover arranged on the lam holder to cover the cavity of the lamp holder, the light-pervious cover comprises a converging lens and a diverging lens adjacent to the converging lens, the light from the light source passing through the converging lens to form the first angular range, and the light from the light source passing through the diverging lens to form the second angular range.

2. The illumination device of claim 1, wherein the inner surface of the lamp holder includes a first curved reflective part and a second curved reflective part which are located at opposite sides of the downward vertical line, the first curved reflective part and the second curved reflective part are shaped and positioned to redirect the light from the light source to the road, a minimal distance between the first curved reflective part and the road is equal to D1, a minimal distance between the second curved reflective part and the road is equal to D2, wherein, D1<D2.

3. The illumination device of claim 2, wherein the light source comprises a light emitting diode.

4. The illumination device of claim 1, wherein the converging lens is selected from a group of biconvex, plano-convex, positive meniscus.

5. The illumination device of claim 1, wherein the diverging lens is selected from a group of biconcave, plano-concave, negative meniscus.

6. The illumination device of claim 1, wherein the converging lens is integrally formed with the diverging lens.

7. The illumination device of claim 1, wherein the light source comprises a light emitting diode.

8. The illumination device of claim 1, wherein the light source is selected from a group of a fluorescent lamp, a metallic halide lamp, an incandescent lamp, a high intensity discharge lamp, a high intensity neon lamp, and a light emitting diode lamp.

9. An illumination device for illuminating a road, comprising:

a lamp holder having an inner surface and a cavity defined by the inner surface;

a light source arranged in the cavity and the inner surface of the lamp holder surrounding the light source, light emitted from the light source being redirected by the lamp holder to establish an illuminating area on the road below the lamp holder, the illuminating area being consisted of a first angular range and a second angular range, along a lengthwise extending direction of the road, the first angular range and the second angular range being located at opposite sides of the lamp holder, the first angular range being directed at an angle Φ1 from a downward vertical line through the lamp holder, the second angular range being directed at an angle Φ2 from the downward vertical line, wherein, Φ2>Φ1, Φ1≦45°; and a light permeable cover arranged on the lamp holder to cover the cavity of the lamp holder, the cover comprising a converging lens and a plane lens adjacent to the converging lens, the light emitted from the light source passing through the converging lens to form the first angular range, and the light emitted from the light source passing through the plane lens to form the second angular range.

10. The illumination device of claim 9, wherein the converging lens comprises a light input surface facing to the light source and a light output surface facing to the road, and a plurality of protrusions are formed on the light output surface.

11. The illumination device of claim 10, wherein the protrusions are in the form of a serration and each protrusion is a triangular prism and extends outwardly from the light output surface of the converging lens.

12. The illumination device of claim 9, wherein the converging lens is integrally formed with the plane lens.

13. The illumination device of claim 9, wherein the inner surface of the lamp holder includes a first curved reflective part and a second curved reflective part which are located at opposite sides of the downward vertical line, the first curved reflective part and the second curved reflective part are shaped and positioned to redirect the light from the light source to the road, a minimal distance between the first curved reflective part and the road is equal to D1, a minimal distance between the second curved reflective part and the road is equal to D2, wherein, D1<D2.

14. The illumination device of claim 9, wherein the light source comprises a light emitting diode.

* * * * *